United States Patent [19]

Leachman

[11] 4,127,285

[45] Nov. 28, 1978

[54] PAMPHLET WITH BACKBONE

[75] Inventor: Frank A. Leachman, Forestville, Conn.

[73] Assignee: The Superior Electric Company, Bristol, Conn.

[21] Appl. No.: 845,758

[22] Filed: Oct. 26, 1977

[51] Int. Cl.[2] ..... B42D 3/00

[52] U.S. Cl. ..... 283/38; 283/64

[58] Field of Search ..... 283/38, 40, 42, 43, 283/64; 281/29, 42

[56] References Cited

U.S. PATENT DOCUMENTS 464,629 12/1891 Brinkley ..... 283/42

2,509,841 5/1950 Rose ..... 283/40

FOREIGN PATENT DOCUMENTS 41,696 8/1925 Norway ..... 283/42

*Primary Examiner*—Frank T. Yost

*Attorney, Agent, or Firm*—Ernest M. Junkins

[57] ABSTRACT

A multi-page, folded and saddle-stitched pamphlet has its back cover formed with a score line and its penultimate page formed with flaps to enable rearward displacement of the back cover page to form an indicia carrying backbone that extends between the score line and the fold line of the pamphlet.

8 Claims, 7 Drawing Figures

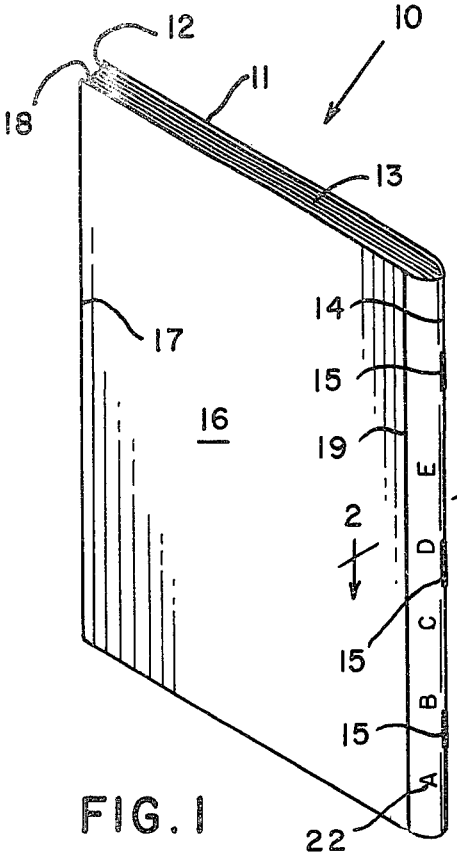
FIG. 1
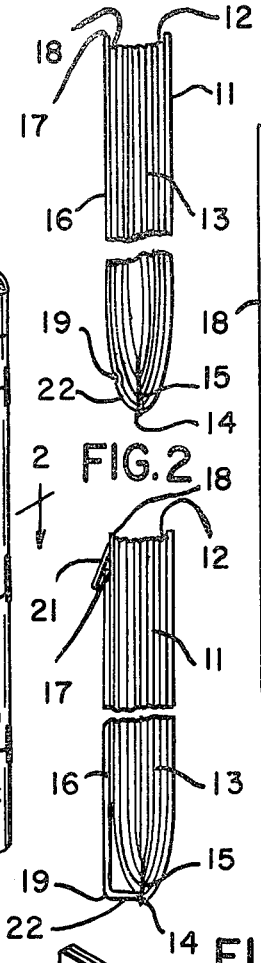
FIG. 2
FIG. 4
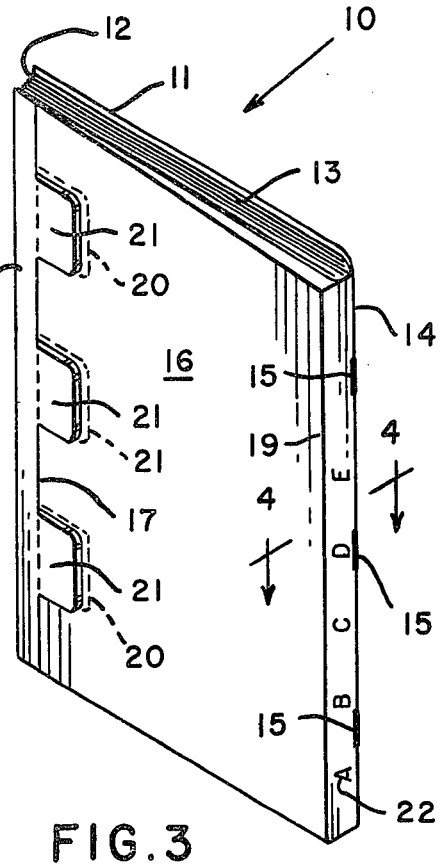
FIG. 3
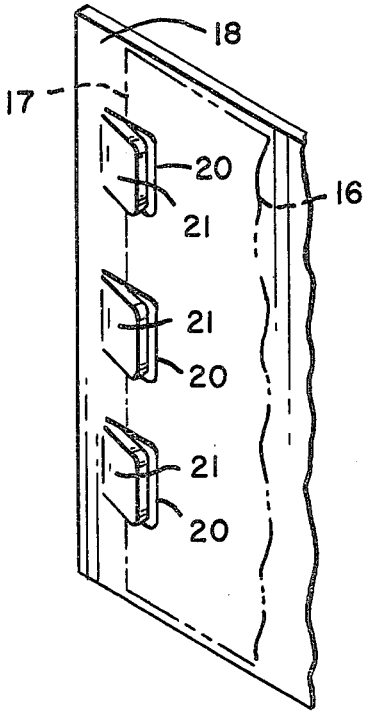
FIG. 5
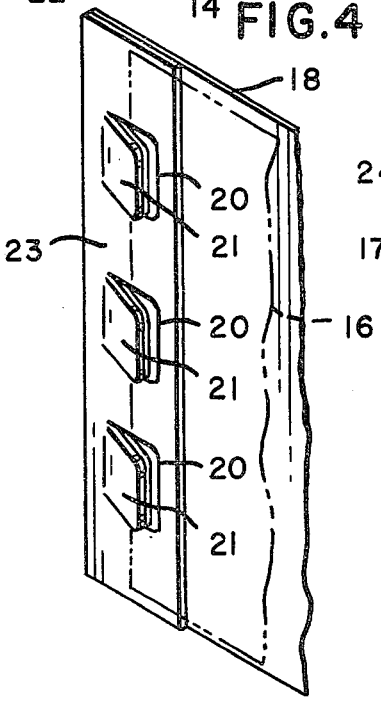
FIG. 6
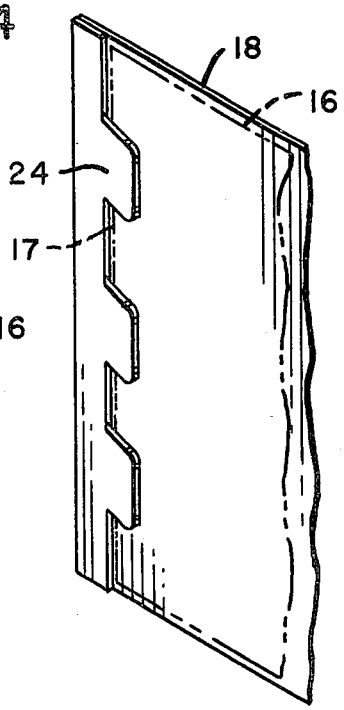
FIG. 7

PAMPHLET WITH BACKBONE

The present invention relates to a multi-page document in which a plurality of sheets are aligned, generally folded in half and then stitched, stapled or otherwise secured at their fold line to form a pamphlet. Typically, a user will receive a plurality of pamphlets from different sources describing different items and will conveniently store the pamphlets in an aligned stack. Each pamphlet will thus only have visible the fold line of its cover sheet which is incapable of carrying indicia identifying the pamphlet. Thus a user, desiring a particular pamphlet in the stack, is required to remove the stack from its storage and shuffle each one while identifying each by its front or back cover until the desired pamphlet emerges. This is quite awkward as compared to selecting a bound volume, such as a book, by a visible backbone on which identifying indicia is placed.

It is accordingly an object of the present invention to provide a saddle-stitched pamphlet which is capable of being formed with a backbone on which identifying indicia may be placed so that the pamphlet is capable of being readily indentified when stored in a stack of pamphlets.

Another object of the present invention is to achieve the above object in a manner which enables the pamphlet, when not desired to have a backbone, to retain the same characteristics of a conventionally saddle-stitched pamphlet.

A further object of the present invention is to provide a saddle-stitched pamphlet which may be formed to have a backbone and in which the pamphlet may be formed in the usual manner with little, if any, increase in cost.

In carrying out the present invention, a saddle-stitched pamphlet having the above described characteristics is formed in the usual manner. However, prior to assembly, a portion of the cover sheet forming the back page has a score line formed therein which is parallel and adjacent to the line on which the cover sheet will be folded. Further, the back side of the penultimate page of the pamphlet is formed to provide or be provided with one or more outwardly extending flaps. The pamphlet is assembled in the same manner as a conventional pamphlet and essentially appears to be of conventional construction.

When an identifying indicia backbone is desired, the user merely forms a 90° fold at the score line by forcing the back cover page backward, positions one or more flaps outwardly towards the back cover and then inserts the free edge of the back cover into the pocket formed between the flaps and the penultimate page. The width of the back cover between the score line and the fold line is thus made to extend essentially perpendicularly to the folded sheets to function as a backbone for the pamphlet. Identifying indicia is preferably imprinted on this width during the imprinting of the cover sheet.

Other features and advantages will hereinafter appear.

In the drawing -

FIG. 1 is a perspective view of the pamphlet of the present invention when it has typical pamphlet characteristics.

FIG. 2 is a perspective view of the pamphlet when it is altered to have a backbone.

FIG. 3 is a section taken on the line 2—2 of FIG. 1.

FIG. 4 is a section taken on the line 4—4 of FIG. 3.

FIG. 5 is a perspective view of the penultimate page in which the penultimate page is formed of heavier stock than the similar page in the previous embodiment.

FIG. 6 is a view similar to FIG. 5 of a further embodiment of a penultimate page in which a reinforced strip is provided where the flaps are formed.

FIG. 7 is a view similar to FIG. 5 of still another embodiment of the penultimate page in which the flaps are formed on material independent of the page and then secured to the page.

Referring to the drawing, the pamphlet of the present invention is generally indicated by the reference numeral 10 and is formed from a plurality of aligned, similar sized sheets. The pamphlet has at least an outer cover sheet 11, a penultimate sheet 12 adjacent thereto and generally, intermediate sheets 13. The sheets are aligned, folded along a fold line 14 and then stapled, as at 15, at a plurality of places on the fold line. Other securing means common with saddle-stitched pamphlets, such as thread stitching, may be employed if desired, without departing from the present invention. The finished pamphlet accordingly has a back cover page 16 having a free edge 17 and a penultimate page 18 adjacent thereto.

Prior to assembly, a score line 19 is formed on the back cover page 16 adjacent to the fold line 14 and parallel thereto. Further, in the embodiment shown in FIGS. 1 through 3, the penultimate page is provided with at least one U-shaped cut 20 with three being shown in the herein illustrated embodiment. Otherwise, the pamphlet is conventionally manufactured.

In use, the user may utilize the pamphlet as one would a conventional pamphlet so that when a plurality of them are stacked either vertically, slanting or horizontally, only the fold line 14 of each is perceivable in the stack. However, if a user desires to be able to identify a pamphlet in the stack, the free portions of the penultimate page 18 defined by the cuts 20 are pushed out toward the back cover page to form flaps 21. The back cover page 16 is folded about 90 degrees on the score line 19 and the free edge 17 of the back cover is positioned between the flaps 21 and the remainder of the penultimate page 18. This causes the width between the fold line 14 and the score line 19 to become essentially perpendicular to the pamphlet and hence visible when the pamphlets are stacked. Preferably, identifying indicia of the pamphlet, as indicated by the reference numeral 22, is printed on this width when the cover sheet is also printed.

Any time the user desires to have the pamphlet of the present invention return to have the characteristics of a conventional pamphlet, the free edge 17 may be removed from the flaps 21, the fold at the score line 19 eliminated and the back cover page caused to assume the position shown in FIGS. 1 and 2 wherein its free edge is aligned with the free edges of the other sheets rather than when a backbone is formed, the free edge is displaced rearwardly from the remaining free edges of the pages of the pamphlet.

Typically, the cover sheet is formed of heavier stock than the other sheets of the pamphlet and thus if the width defining the backbone between the fold line and the score line 19 is on the order of perhaps ½ inch, such a width will be sufficiently rigid to retain its shape against the compressive forces inherently existing in the stack while still providing sufficient width for identifying indicia. A narrower width may cause the indentifying indicia to be insufficiently perceivable while a wider extent may become subject to collapsing because of the compressive forces. It is to be understood however that the above dimension is accordingly only illustrative and is not a limitation on the scope of the present invention.

The penultimate page shown in the FIG. 5 embodiment differs from the previously described penultimate page in that it is formed of stock having a somewhat heavier weight than the remaining intermediate sheets of the pamphlet. Such a stock could approximate that of the cover sheet if desired. In the further embodiment of the penultimate page shown in FIG. 6, a reinforcing strip of perhaps transparent plastic tape 23 may be applied to the back of the penultimate page along its free edge where the flaps are formed in order to provide flaps that are more resistant to mutilation. Alternatively, rather than having a flap formed by a cutout to be integral with the penultimate page, they may be formed integral with a strip 24 attached adjacent the free edge of the penultimate page. In all the embodiments of the penultimate page, it will be appreciated that one or more flaps are formed which are hinged to enable projection towards the back cover page to form a pocket that retains the free edge of the back cover sheet between the penultimate page and the flap. In the embodiment shown in FIG. 7, if desired, one flap may be formed to extend the complete length of the page rather than a plurality of flaps as shown.

When a pamphlet has a backbone, it appears to be as easily reinserted into the stack as when it does not have the backbone.

It will accordingly be understood that there has been disclosed a pamphlet which is capable of being formed to have a backbone on which identifying indicia may be imprinted in order to facilitate the identifying of the pamphlet when it is stored in a stack with other pamphlets. A backbone is economically and conveniently formed as the portion of the back cover page that extends between a score line and the fold line of the pamphlet by displacing the free edge of the back cover sheet rearwardly. The back cover page is held in this displaced condition by restraining means that is carried by the penultimate page of the pamphlet with one form specifically being flaps that are integral with the penultimate page.

Variations and modifications may be made within the scope of the claims and portions of the improvements may be used without others.

I claim:

1. A saddle-stitched pamphlet formed to provide an indicia identifying backbone comprising a plurality of aligned sheets with said sheets being folded on a fold line, means securing the sheets together at the fold line to form a plural page pamphlet, one of the outermost cover pages being formed with a score line parallel to and adjacent the fold line, and restraining means carried by the page adjacent said one cover page and operable to engage the free edge of said one cover page whereby said one cover page is adapted to be folded on said score line to form a backbone between the score line and the fold line with the fold being maintained by the free edge of the one cover sheet engaging the restraining means.

2. A saddle-stitched pamphlet having a backbone comprising a plurality of aligned sheets folded on a fold line, means securing the sheets together at the fold line with each of said sheets forming two pages with each page having a free edge, a score line extending adjacent to and parallel to the fold line formed on an outermost cover page, said cover page being folded on said score line, and means for maintaining the free edge of said cover page displaced nearer the fold line than the free edges of the other sheets whereby the portion of said cover page between the score line and the fold line constitutes a backbone capable of carrying identifying indicia.

3. The invention as defined in claim 2 in which the maintaining means includes at least one flap carried by the page adjacent the cover page with the flap being displaced from the plane of the adjacent page towards the cover page.

4. The invention as defined in claim 3 in which the flap is an integral part of the adjacent page.

5. The invention as defined in claim 4 in which there are intermediate pages formed of similar stock material and in which the adjacent page is formed of similar stock material.

6. The invention as defined in claim 4 in which there are intermediate pages formed of similar stock material and in which the adjacent page is formed of heavier stock material.

7. The invention as defined in claim 3 in which there is a reinforcing strip secured adjacent the free edge of the adjacent page and in which the flap is formed from a part of the reinforcing strip and the adjacent page.

8. The invention as defined in claim 3 in which there is a strip secured adjacent the free edge of the adjacent page and in which the flap is formed by the strip.

* * * * *